US006857530B2

(12) United States Patent
Yourist

(10) Patent No.: US 6,857,530 B2
(45) Date of Patent: Feb. 22, 2005

(54) PACKAGE OF INTERENGAGING CONTAINERS FOR COMPANION PRODUCTS

(75) Inventor: Sheldon Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 10/340,044

(22) Filed: Dec. 10, 2002

(65) Prior Publication Data

US 2003/0160018 A1 Aug. 28, 2003

Related U.S. Application Data

(63) Continuation-in-part of application No. 29/156,184, filed on Feb. 26, 2002, now Pat. No. Des. 472,150.

(51) Int. Cl.[7] ..... B65D 21/00; B65D 21/02; A47G 19/00

(52) U.S. Cl. ..... 215/10; 215/6; 220/23.4; 53/48.2; 53/446

(58) Field of Search ..... 215/6, 10, 384; 206/432, 504; 220/23.83, 23, 4, 23.4; 53/48.2, 153, 446, 448, 158

(56) References Cited

U.S. PATENT DOCUMENTS

| | | | | |
|---|---|---|---|---|
| 1,459,257 A | | 6/1923 | Reger | |
| D190,101 S | | 4/1961 | Mangini | |
| D192,980 S | | 6/1962 | Mangini et al. | |
| D194,165 S | | 11/1962 | Riley et al. | |
| 3,194,426 A | | 7/1965 | Brown, Jr. | 220/23.4 |
| 3,269,389 A | * | 8/1966 | Meurer et al. | 215/10 |
| 3,380,608 A | | 4/1968 | Morbeck | |
| 3,404,505 A | * | 10/1968 | Hohl et al. | 53/448 |
| 3,889,834 A | * | 6/1975 | Harris, Jr. | 215/10 |
| 3,933,268 A | * | 1/1976 | Buske | 220/23.4 |
| 4,003,491 A | * | 1/1977 | Wells et al. | 220/23.4 |
| 4,165,812 A | | 8/1979 | Jennison | 215/10 |
| 4,196,808 A | | 4/1980 | Pardo | 206/432 |
| 4,258,847 A | * | 3/1981 | Nierman | 206/504 |
| D263,118 S | | 2/1982 | Weckman | |
| 4,509,639 A | * | 4/1985 | Thompson | 206/504 X |
| D280,599 S | | 9/1985 | Green | |
| 4,573,595 A | * | 3/1986 | Mednis | 215/10 |
| 4,607,756 A | | 8/1986 | Courtman | 215/6 |
| D288,526 S | | 3/1987 | Parad | |
| D302,656 S | | 8/1989 | Green | |
| 4,925,066 A | | 5/1990 | Rosenbaum | 215/10 X |
| D313,346 S | | 1/1991 | Fiore | |
| D313,347 S | | 1/1991 | Fiore | |
| 5,007,540 A | | 4/1991 | Beasley et al. | 215/10 X |
| D319,970 S | | 9/1991 | Beeman | |
| D324,995 S | * | 3/1992 | Yan | D9/341 |
| 5,135,823 A | | 8/1992 | Eales | 215/6 X |
| 5,158,191 A | | 10/1992 | Douglas et al. | 215/10 |
| 5,158,209 A | | 10/1992 | Reil et al. | 215/6 X |
| D333,263 S | | 2/1993 | Markuzov | |

(List continued on next page.)

FOREIGN PATENT DOCUMENTS

EP 613825 A1 * 9/1994

*Primary Examiner*—Sue A. Weaver
(74) *Attorney, Agent, or Firm*—Venable LLP; Keith G. Haddaway; James R. Burdett

(57) ABSTRACT

A package for companion products has two containers (102, 104), each comprising a mating formation (408, 502) protruding in a direction toward the other container and defining a mating surface facing at an angle to the direction of protrusion and engaging the mating surface of the other container. Each container has a generally flat bottom and a center of gravity in vertical alignment with the generally flat bottom, whereby each container can stand independently of the other container. The shape of each container is the same as the other, and the containers are attached to one another. The shape enables the mating surfaces to be brought into engagement with one another by movement in a plane parallel to the bottoms of the containers.

30 Claims, 7 Drawing Sheets

U.S. PATENT DOCUMENTS

| | | | | |
|---|---|---|---|---|
| 5,252,312 | A | 10/1993 | Gentile et al. | 215/6 X |
| 5,316,159 | A | 5/1994 | Douglas et al. | 215/10 |
| 5,318,203 | A | 6/1994 | Iaia et al. | 222/94 |
| 5,392,947 | A | 2/1995 | Gentile | 215/6 X |
| 5,607,072 | A | 3/1997 | Rigney et al. | 215/10 |
| D388,698 | S | 1/1998 | Newsom | |
| 5,735,422 | A | 4/1998 | Binter | 215/6 X |
| 5,794,819 | A | 8/1998 | Smith | 222/129 |
| 5,823,391 | A | 10/1998 | Klauke et al. | 222/94 |
| D404,302 | S | 1/1999 | Martin | |
| 5,865,345 | A | 2/1999 | Cistone et al. | 222/94 |
| 5,921,440 | A | 7/1999 | Maines | 222/145.2 |
| 5,954,213 | A | 9/1999 | Gerhart et al. | 215/10 |
| 5,954,231 | A | 9/1999 | Durliat et al. | 222/1 |
| 6,065,643 | A | 5/2000 | Harvey et al. | 222/54 |
| D429,633 | S | 8/2000 | Godio | D9/341 |
| 6,123,214 | A | 9/2000 | Goebel | 220/23.4 |
| 6,161,729 | A | 12/2000 | Gentile et al. | 220/94 |
| 6,179,146 | B1 | 1/2001 | Betras | 220/23.4 |
| 6,186,349 | B1 | 2/2001 | Tempongko | 220/4.22 |
| D439,156 | S | 3/2001 | Hall et al. | D9/341 |
| 6,206,218 | B1 | 3/2001 | Young et al. | 220/23.4 |
| 6,223,942 | B1 | 5/2001 | Markey et al. | 222/94 |
| 6,276,549 | B1 | 8/2001 | Fasci et al. | 220/23.4 |
| D449,224 | S | 10/2001 | Kaufman | D9/338 |
| D449,778 | S | 10/2001 | Legoupil et al. | D9/341 |
| D451,029 | S | 11/2001 | Hoffman | D9/524 |
| 6,325,229 | B1 | 12/2001 | Anders | 220/23.4 |
| 6,341,716 | B1 | 1/2002 | Goettner et al. | 222/94 |
| D454,068 | S | 3/2002 | Hanson | D9/524 |
| 6,419,783 | B1 | 7/2002 | Rainey et al. | |

* cited by examiner

PACKAGE OF INTERENGAGING CONTAINERS FOR COMPANION PRODUCTS

RELATED APPLICATIONS

This application is a continuation-in-part of application Ser. No. 29/156,184, filed Feb. 26, 2002 now U.S. Pat. No. D,472,150.

BACKGROUND OF THE INVENTION

1. Field of the Invention

The present invention relates generally to interconnected packaging, and more particularly to interconnected bottles.

2. Related Art

It is commercially desirable to be able to offer two or more related products together in one package to a consumer. For example, a manufacturer might wish to package together different flavored syrups, or condiments for sandwiches, or even bath products. Conventional solutions to packaging-related or companion products have many shortcomings.

In some conventional companion product packaging, the individual containers cannot stand up by themselves until joined to their counterparts. Containers that cannot stand up by themselves complicate automated manufacturing processes that often require transporting the containers on a conveyor system in an upright position. In particular, containers which can not stand up or maintain an upright position are harder to fill automatically and separately.

Other conventional companion product packaging is comprised of two containers, different in shape from one another, joined in a "lock and key" type interlocking configuration. This configuration has several disadvantages. For example, manufacture of the individual containers requires bottle manufacturing molds having different mold shapes from one another for molding the different container shapes. The use of two or more different molds slows production and increases production costs. Further, a "lock and key" type interlocking configuration requires relatively complex movements to connect the bottles together in preparing the finished product. For example, connecting the containers may require lifting one container relative to the other. Adding steps to or complicating the manufacturing process increases production costs and may require the development of additional automated manufacturing systems.

What is needed then, is an interconnected container package that overcomes the shortcomings of the conventional solutions.

SUMMARY OF THE INVENTION

In an exemplary embodiment of the present invention, an inter-engaging container package for companion products is disclosed.

The present invention is a package comprising two individual containers, or bottles, that are joined together. The individual bottles are identical in configuration so that they all can be made from a single mold. The two bottles may differ by, for example, being made of different colors or having different closures attached to each. Each bottle may be individually labeled either before, during or after manufacture and filling. Alternatively, a single label, for example a shrink-wrap label, applied to the package, can function to hold the bottles together.

The structure of the individual bottles of the present package enables the use of simplified manufacturing processes that do not require lifting or tilting of one container relative to the other, but only require that the containers be brought into contact. For example, the bottles may be moved in an upright position along a conveyor towards one another, oriented for back to back contact. The flat bottom and the ability of each bottle to maintain an upright position without additional support enables the use of simple automated equipment. The bottles may be moved, for example, in a direction of motion generally parallel to back of each bottle and perpendicular to the mating formation on each container. According to this method, it is only necessary that one bottle be in motion. However, both bottles can be moved along separate conveyors towards one another.

The offset neck of the present bottles enables sensing of the relevant orientations of the bottles and, if necessary, re-orientation of one or both bottles of a package. For example, using the formation shown in the accompanying figures, the two bottles can be moved toward one another in such a way that the offset neck is in a trailing position relative to the direction of motion. Sensing equipment well known in the art to sense, for example, plastic motor oil containers having an offset neck can be used to sense the position of the neck relative to the direction of motion. If the offset neck of one or both of the bottles is, for example, near the leading side of a bottle relative to the direction of motion and should be near the trailing side, appropriate equipment can then turn the bottle or bottles to an orientation wherein the offset neck is near the trailing side of the bottle relative to the direction of motion. Of course, if the sensing equipment indicates that the neck is already near the trailing side, reorientation is not necessary.

As the two bottles approach one another, they can be oriented in such a way that the back of one bottle contacts the back of the second bottle and, as motion continues, the backs slide one along the other. This motion can be continued until the mating formation of one bottle comes into contact with the mating formation of a second bottle. The advantage of the illustrated embodiment, i.e., where the mating formations are substantially perpendicular to the backs of the bottle, is that, when the mating formation of each bottle comes into contact with the mating formation of the other bottle, the contact stops the relative motion between the bottles at a point where the sides of the bottles are in alignment with one another. Once the bottles are positioned together, they are attached to one another to maintain these positions in the package.

The package of the present invention can be used for substantially fluid products. Each bottle may have contained therein the same product, or each bottle may be filled with different products. When the individual bottles are filled with different products, the package is particularly well suited for "companion products." Companion products are two different products with similar or related uses, that are associated. Examples of companion products include: different flavored syrups, for example, chocolate and strawberry flavored syrups for milk or chocolate and caramel syrups for ice cream; condiments, for example, ketchup and mustard or ketchup and relish; and personal care products, for example, hair shampoo and hair conditioner.

Further features and advantages of the invention, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of an exemplary embodiment of the invention, as illustrated in the accompanying drawings, wherein.

DETAILED DESCRIPTION OF AN EXEMPLARY EMBODIMENT OF THE PRESENT INVENTION

A preferred embodiment of the invention is discussed in detail below. While specific exemplary embodiments are discussed, it should be understood that this is done for illustrative purposes only. A person skilled in the relevant art will recognize that other components and configurations can be used without departing from the spirit and scope of the invention.

Figure 1:
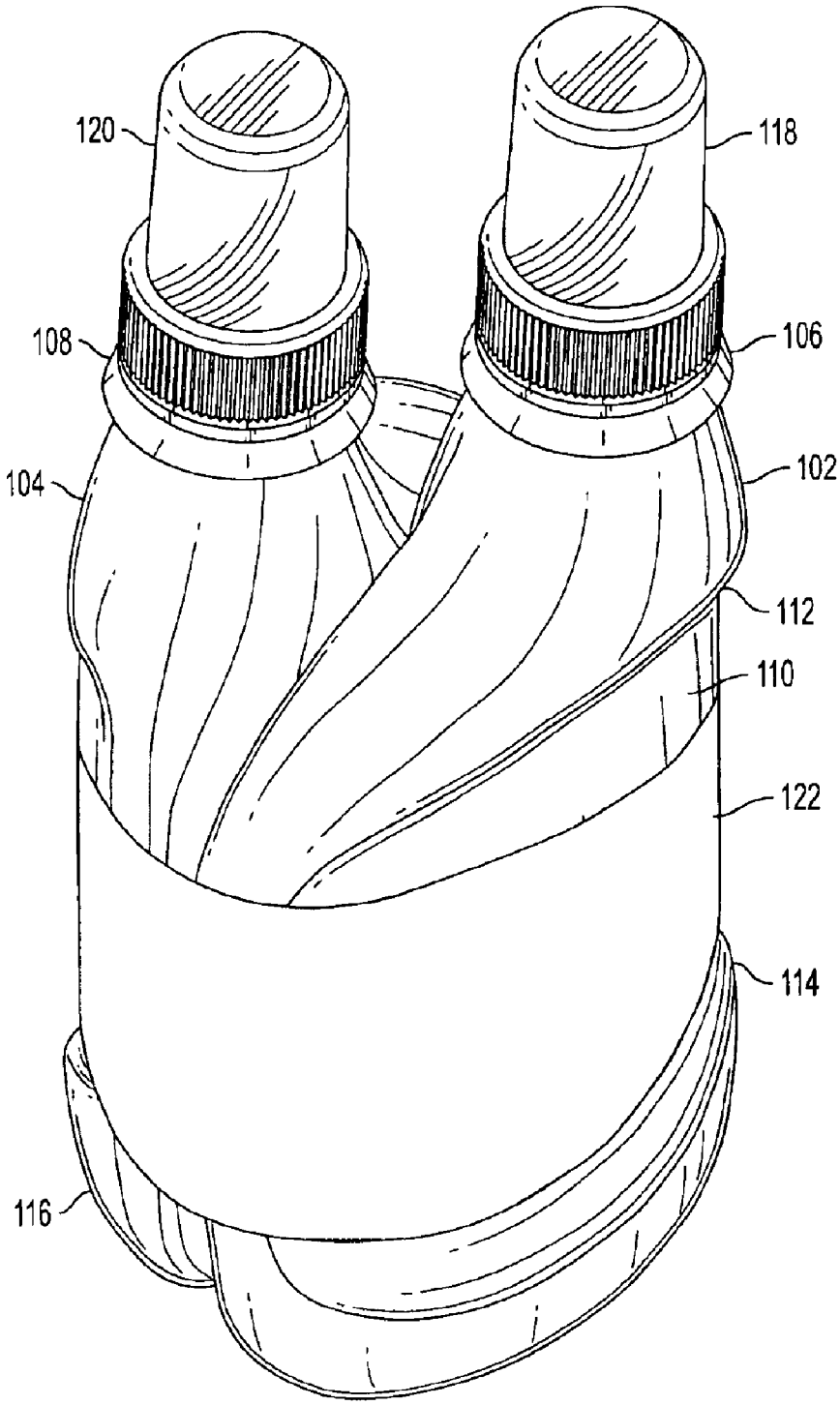
FIG. 1 is a perspective view from the top and left side of interlocking containers for companion products, according to the present invention.

As can be seen from FIG. 1, in an exemplary embodiment of the present invention, the interlocking package comprises of two identical bottles, or containers, 102 and 104. Using two identical bottles means that only one mold is needed, thereby simplifying and expediting the manufacturing process.

Each bottle 102 and 104 has a neck 106 and 108, respectively, that is offset from the center of the bottle, toward one side. When the bottles 102 and 104 are arranged back to back, as shown in FIG. 1, the necks 106 and 108, respectively, are arranged at opposite sides of the package. The offset neck 106, 108 of each bottle 102, 104 provides an increased separation between the necks that enables the bottles to be filled more easily with separate products simultaneously when the bottles are joined. Additionally, the offset neck arrangement enables sensing devices to detect the orientation of the bottle during transport through a bottle conveyor before joining and to correct the orientation when needed. The offset of the neck(s) is not limited to the particular configuration shown in the illustrated embodiment. The configuration may vary by, for example, having each neck on the left or right side of the bottle or positioning the neck(s) closer to or further from the midline of the bottle.

The bottom 116 of each bottle is substantially flat, and the center of gravity 204 (See FIG. 2) of each bottle, both when empty and filled, is in vertical alignment with the bottom. As a result, each bottle can stand alone. Because the bottles can stand alone, they can be filled simply, without needing additional support to remain upright.

Each bottle 102, 104 also has a curved recessed grip area 110, with an upper shoulder 112 above the recessed grip area 110 and a lower shoulder 114 below the recessed grip area 110. The presence of shoulders both above and below the recessed portion helps prevent the bottle from sliding when held by the consumer in either an upright or inverted position.

The recessed grip 110 may also be a label panel. A label 204 (See FIG. 2) may be applied to each individual bottle by, for example, gluing a label onto the finished package or by an in-mold labeling process. The labels may be the same or different and may be applied either before or after joining the individual bottles to form the finished package. Alternatively, a shrink-wrap label 122 may be applied to the finished package after manufacturing. A shrink-wrap label has the additional advantage of holding the individual bottles together in the finished package. When a shrink-wrap label is used, the upper shoulder 112 and lower shoulder 114 further function to hold the shrink-wrap label 122 in place and prevent either of the individual bottles from sliding up or down in the finished package, thus maintaining the configuration without the need for glue.

Figure 2:
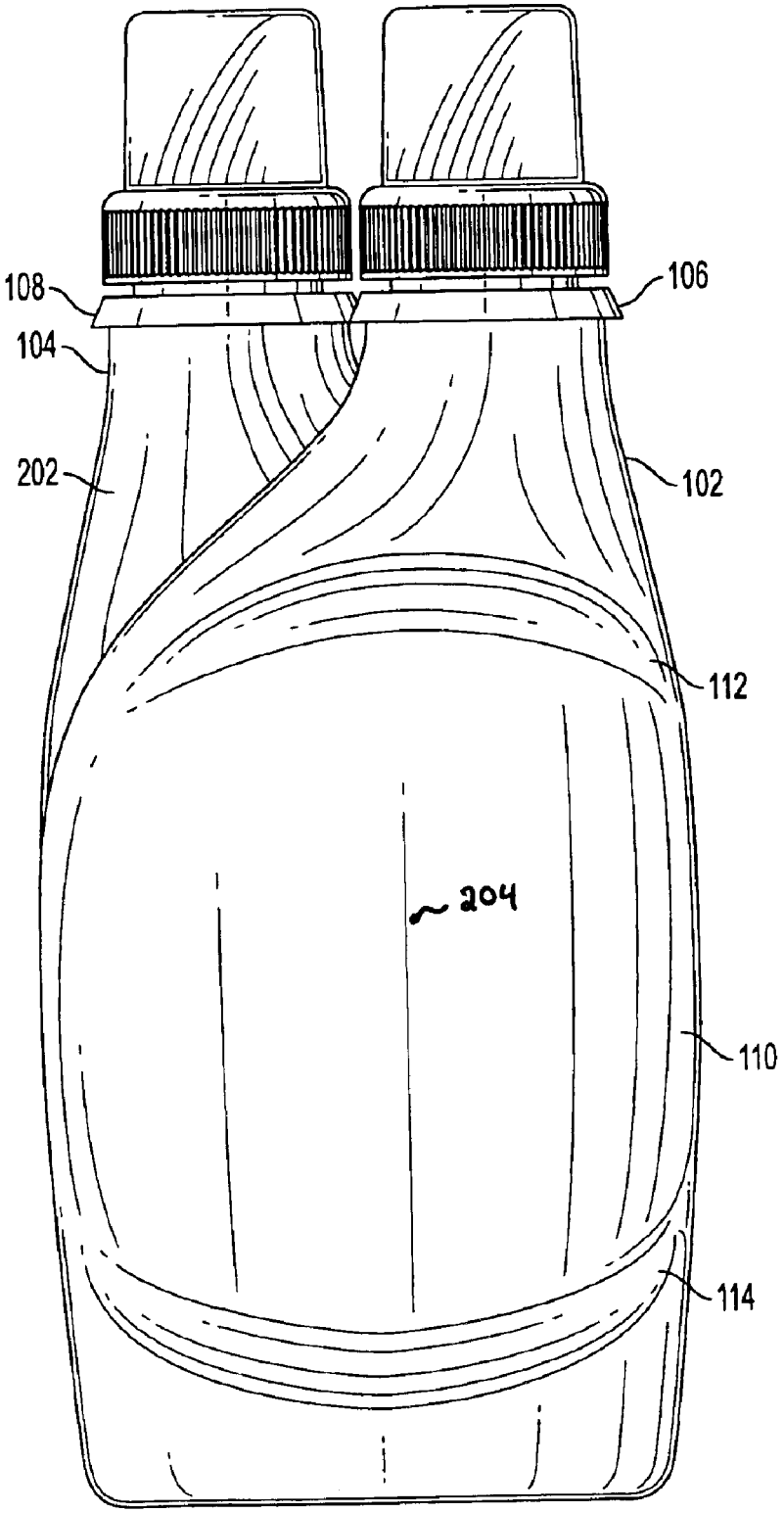
FIG. 2 is a front elevation of the interlocking containers of FIG. 1.

As can be seen from FIG. 2, the necks 106 and 108 are offset both from the vertical centerlines of their respective bottles 102 and 104, and also from each other. FIG. 2 shows the front of bottle 102, indicating the position of the recessed grip 110 relative to the upper and lower shoulders 112 and 114, respectively. A label 204 can optionally be placed on the recessed grip 110. The bottle 104 has a back side 202 that is visible around the offset neck of the bottle 102. Rotating the package of FIG. 2 180° would yield a view having an identical appearance, but showing the front of the second bottle 104 and a portion of the back of the first bottle 102.

Figure 3:
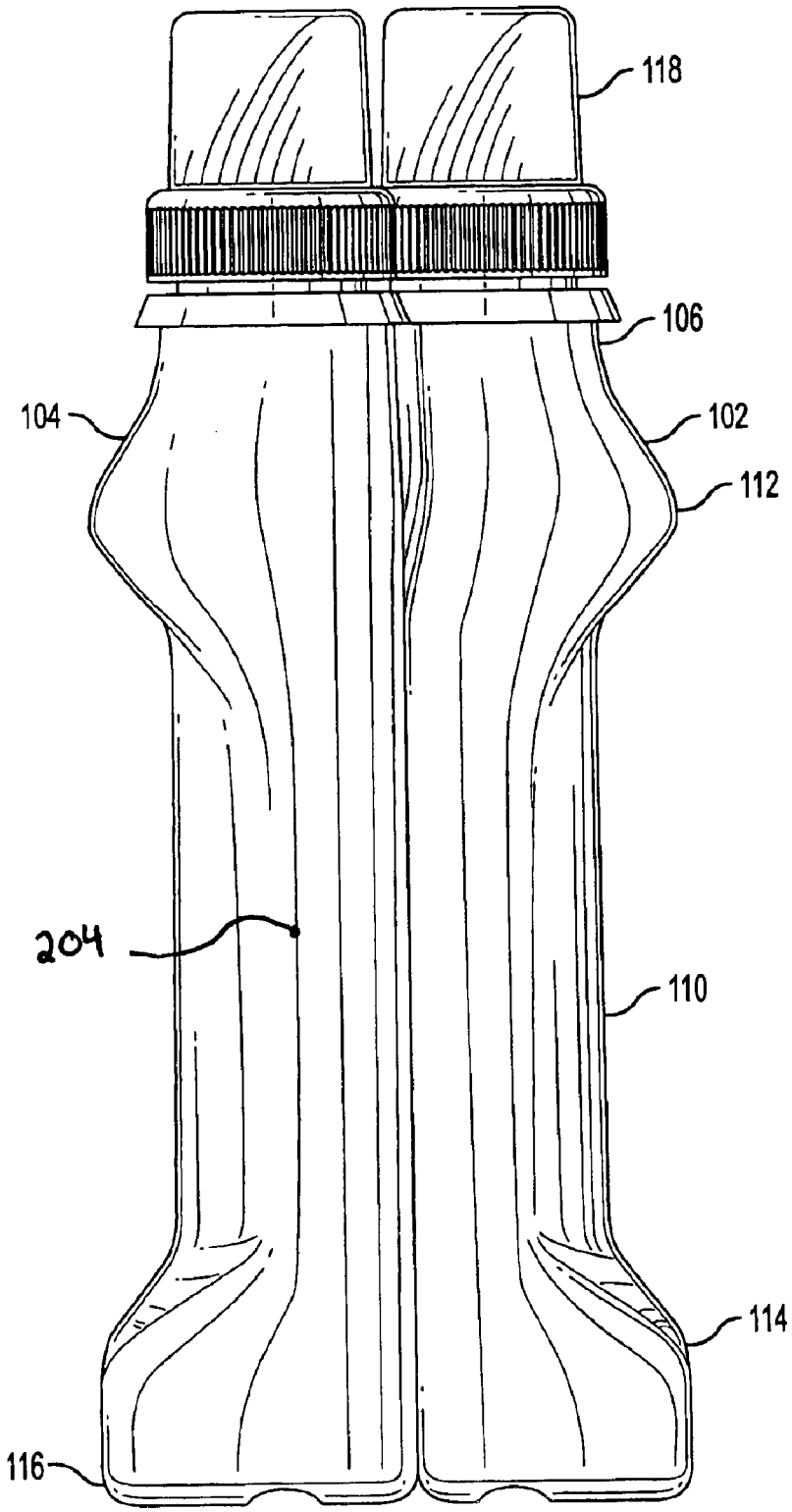
FIG. 3 is a right side elevation of the interlocking containers of FIG. 1.

As is shown in FIG. 3, the bottoms of the bottles 102, 104 are substantially flat. Also, the finished package presents a profile creating at least the appearance that the back of each bottle is flat. FIG. 3 also shows an alternative placement of the shrink-wrap label 122. According to this alternative placement, the shrink wrap extends from a lower position 302 that is below the lower shoulder 114 to an upper position 304 that is above the upper shoulder 112. This placement allows an increased label area for placement of product graphics. As will be appreciated, the position of the shrink-wrap label is not limited to the placements shown in FIG. 1 and FIG. 3. The placement may be, for example, a combination of the two illustrated embodiments, such as in a position extending from below the lower shoulder 114 to the upper shoulder 112 or from the lower shoulder 114 to a position above the upper shoulder 112. Other placements of the shrink-wrap label are also contemplated by the invention.

Figure 4:
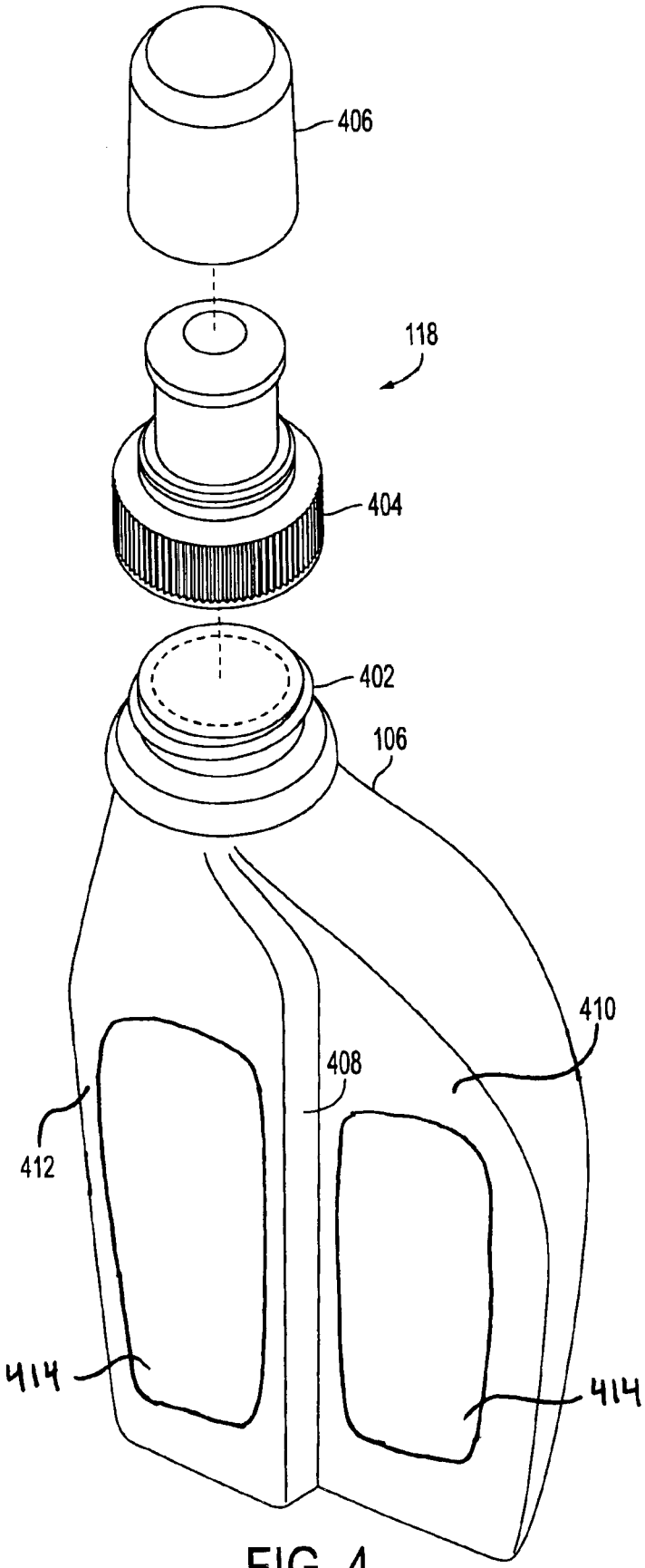
FIG. 4 is a top, rear perspective view of the front container of FIG. 2, with a closure and cap exploded.

With reference to FIG. 4, the description which follows is directed to the bottle 102. The description applies to the second bottle 104 as well. Where previously expressed, the corresponding reference number for the second bottle 104 is shown in parentheses.

As will be appreciated by persons skilled in the art, the neck 106 (108) of bottle 102 (104) may include a finish, or structure, 402. The finish 402 may be, for example, threads, as shown in FIG. 4, to accommodate a threaded portion of the closure 118 (120). Alternatively, the finish may comprise a molded ring to accommodate a snap-fit or friction-fit closure. The closure may comprise any known suitable closure, or closures yet to be developed. For example, as shown in the illustrated embodiment, the closure may comprise a spout portion 404 that may be covered with a removable cap 406. The closure 118 (120) may be joined to the bottle 102 (104) by, for example, a corresponding threaded portion on the finish 402 of the bottle. Alternatively, the closure 118 (120) may be attached to the bottle 102 (104) by a snap-fit or friction-fit mechanism. Methods for joining a suitable closure to a container are well known in the art.

The back of the bottle 102 (104) includes a mating formation for aligning the individual bottles of the package. In the illustrated embodiment, the mating formation comprises a ridge 408 extending from a substantially planar, or flat, recessed back surface 410 to a substantially planar, or flat, raised back surface 412 of the bottle. The ridge 408 is approximately perpendicular to the lower recessed back and raised back surfaces 410 and 412, respectively. The recessed back surface 410 and raised back surface 412 are substantially parallel, but not coplanar. Thus, they lie in planes that are parallel to and spaced from one another. This configuration of the back of the bottle provides for simplified manufacture of the container, i.e., for a simplified means of aligning and joining the individual bottles to form the container.

Figure 5:
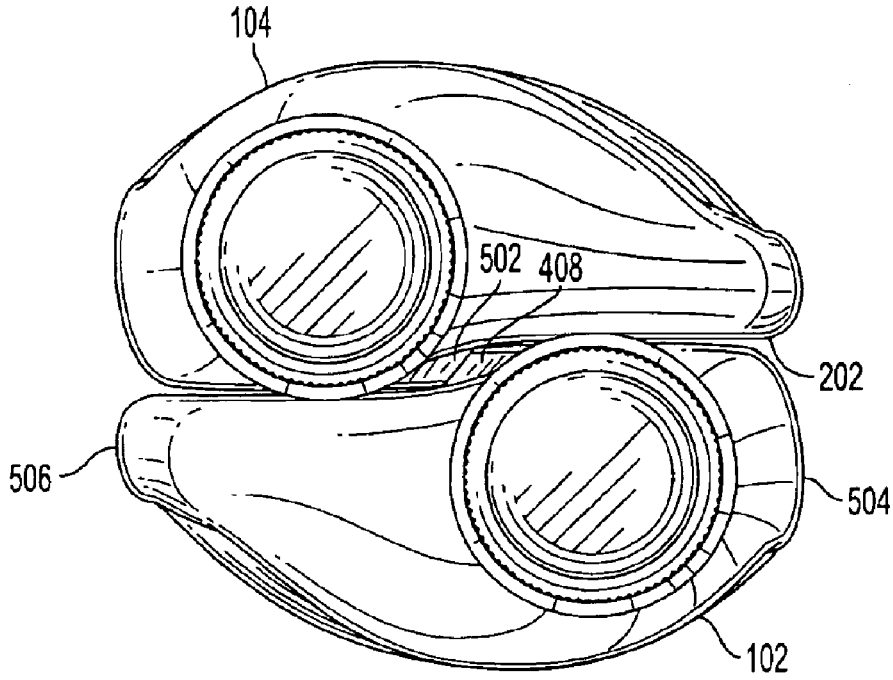
FIG. 5 is a top plan view of the interlocking containers of FIG. 1.
Figure 6:
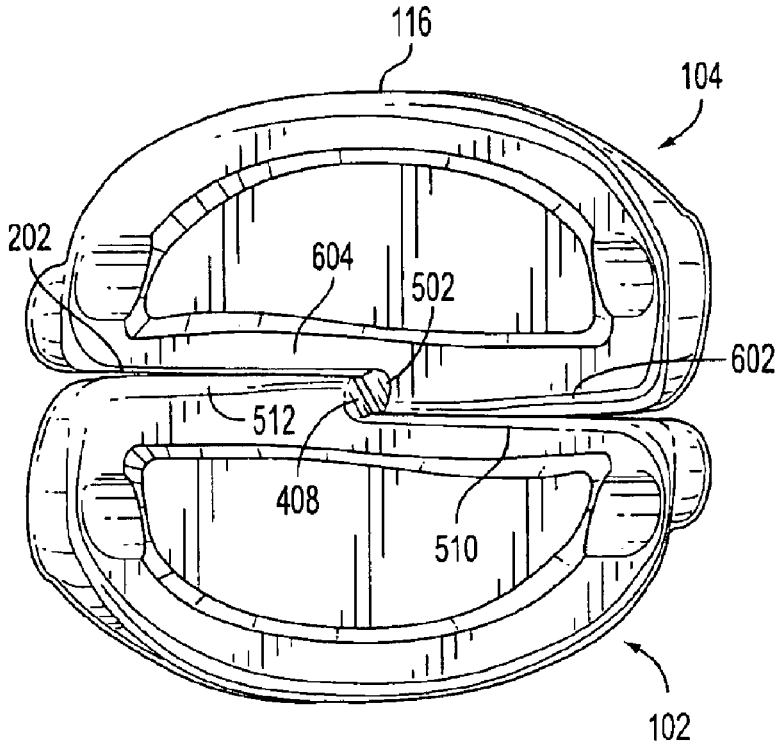
FIG. 6 is a bottom plan view of the interlocking containers of FIG. 1.

The mating formation 408 on bottle 102 and the mating formation 502 on bottle 104 are identical. As can be appreciated from FIG. 5 and 6, the mating formation 408 on the bottle 102 protrudes in a direction toward the bottle 104 and abuts the corresponding mating formation 502 on the bottle 104. Each mating formation 408, 502 has a mating surface facing at an angle in the direction of protrusion and contacting the mating surface of the other bottle. The mating formations 408 and 502 enable the bottles to be interconnected by moving at least one of the bottles toward the other in a straight line in a plane parallel to the generally flat bottoms such that the mating surfaces come into engagement with one another. In the illustrated embodiment, the back wall 202 of the bottle 104 can be slid along the back wall of bottle 102 in a direction generally parallel to the back walls of the bottles and perpendicular to the direction in which the mating formations extend from the bottles. The mating formations also function to stop the bottles during the mating motion and to align the bottles in the precise orientation required. The bottles can be glued together with adhesive 414 on the recessed and raised back surfaces 410 and 412, or shrink-wrapped together by, for example, a shrink-wrap label 122 (see FIG. 1), when the individual bottles are mated.

In this exemplary embodiment, the bottle 102 has a wide side 504 and a narrow side 506. The front surface of the bottle curves from the wide side 504 to the narrow side 506 and enables the bottle to be squeezed easily while connected to the bottle 104.

Mating formations 408 and 502 can mate to hold the bottles 102 and 104 together. Moreover, when the first bottle 102 and second bottle 104 are combined to form the package, the recessed back surface 510 of the first bottle 102 abuts the raised back surface 602 of the second bottle 104 in substantially flush contact. Similarly, the raised back surface 512 of the first bottle 102 abuts the recessed back surface 604 of the second bottle 104 in substantially flush contact.

The package of the present invention can comprise any material known in the art and generally used for the described applications, as well as others. These materials include plastics for example, polyethylene terephthalate (PET), low density polyethylene (LDPE), high density polyethylene (HDPE), and nylons, as well as other polyesters, polyolefins, polycarboxyamides, and polycarbonates having suitable properties for the intended application. The bottles can be manufactured from resilient and pliable plastic materials so that they are squeezable.

Figure 7:
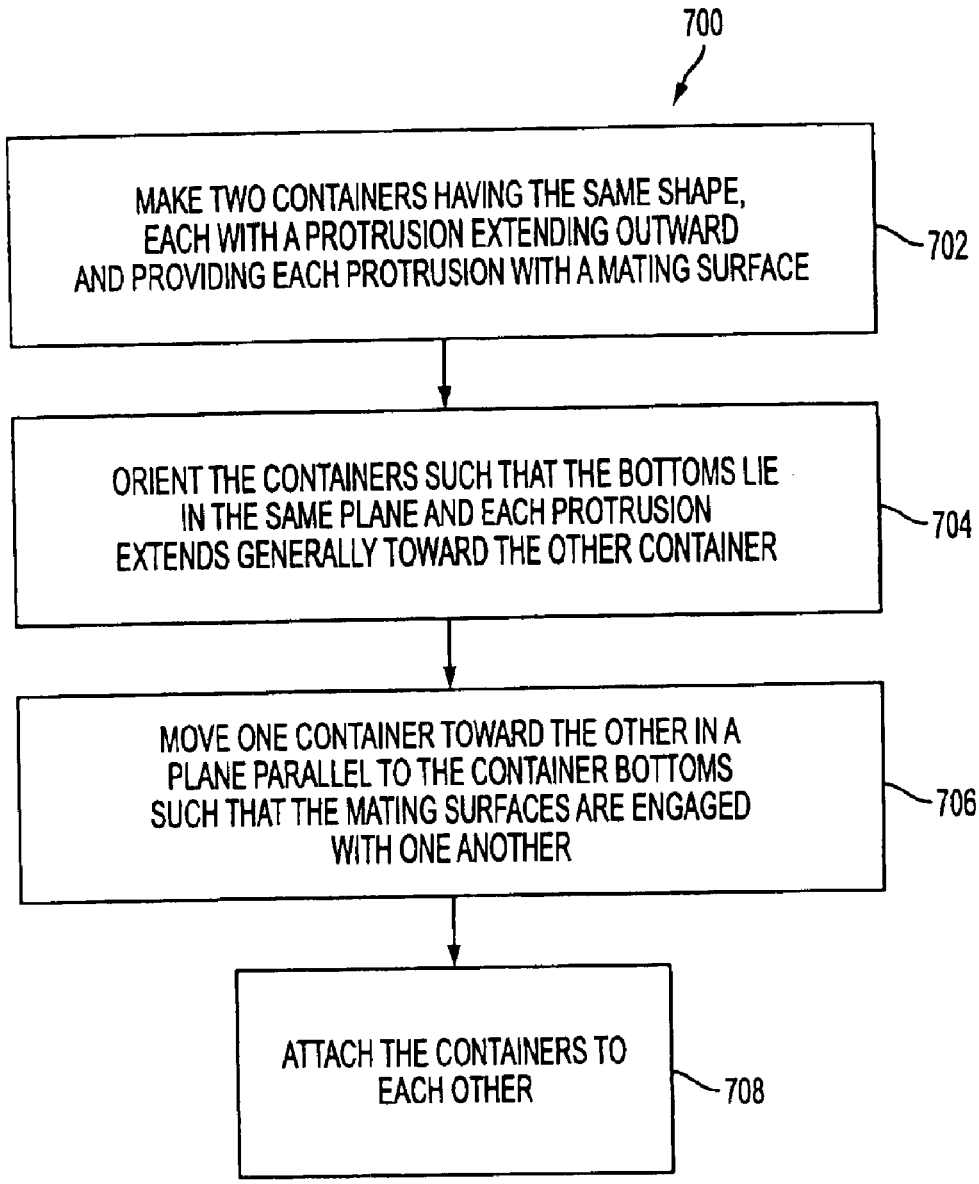
FIG. 7 is a flowchart of a method according to an exemplary embodiment of the present invention.
Figure 8:
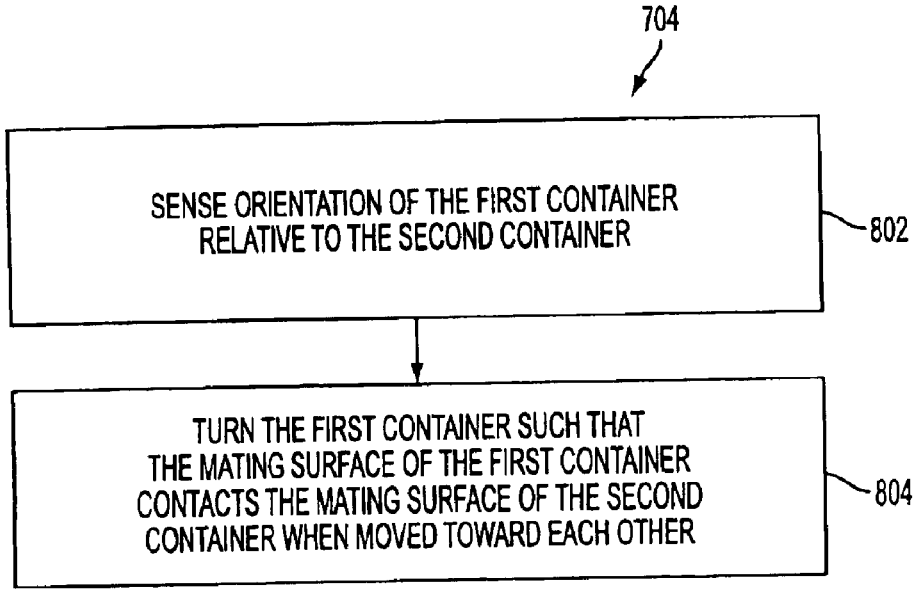
FIG. 8 is a flowchart of a method of orienting the containers according to an exemplary embodiment of the present invention.

An exemplary embodiment of a method of making a package of interlocking containers is illustrated in a flowchart 700 in FIG. 7. Two containers having the same shape, each with a protrusion extending outward are made, and each protrusion is provided with a mating surface in step 702. Then the containers are oriented such that the bottoms of the containers lie in the same plane and each protrusion extends generally toward the other container in step 704. The containers are then moved toward each other in a plane parallel to the container bottoms such that the mating surfaces are engaged with one another in step 706. The movement can be a straightline movement. Additionally, the movement can be in a direction transverse to the direction of the protrusion extension. Finally, the containers are attached to each other in step FIG. 8 shows a flowchart 706 of a method of orienting the containers. The orientation of the containers relative to each other can be sensed in step 802. Then, the first container is turned such that the mating surface of the first container contacts the mating surface of the second container when they are moved toward each other. The sensing of the orientation of the containers can include detecting the position, relative to the direction of motion of said first container, of a neck of the first container that is offset from the vertical centerline of the container.

The two individual bottles can be attached in several ways. For example, an adhesive, or glue, can be applied to the back of one or both of the containers, such that, after the containers come into contact in the proper orientation, the glue, is allowed to set and the two bottles are affixed to one another. Alternatively, after the bottles are properly positioned, a shrink wrapping that can include a label or labels can be applied around the package, i.e. encircling the two individual bottles. Heat can then be applied to the shrink wrap in order to fix it to the package and hold the relative positions of the two bottles. One advantage to the illustrated embodiment is that a shrink wrap label can be positioned between the upper shoulder and the lower shoulder surrounding the recessed grip area. The advantage to this particular configuration is that the bottles are, after affixing of the shrink wrap, essentially locked into position in such a way that the bottles cannot move up and down relative to one another due to the engagement of the shrink wrap with the upper and lower shoulders. Similarly, relative sideways motion between the two containers is prevented by the presence of the shrink wrap, as well as the presence of the mating formations. This, therefore, provides an economical means of labeling containers of the invention.

The bottles that comprise the package can be manufactured by methods well-recognized in the art, for example, blow molding, injection molding, injection blow molding and extrusion blow molding. The bottles can also be made of individual components that are joined. The two bottles that comprise the container can be manufactured at the same time and joined, or can be made at different times for later joining. A particular advantage of the present invention is that the two bottles can be made from the same mold or identical molds. Thus, if the container is to be prepared from a black bottle and a white bottle, the requisite number of white bottles can be made using a plastic with a white pigment. By a separate process, the requisite number of black bottles, can be made in the same mold or an identical mold using a plastic having a black pigment. Both the white and the black bottles can be prepared from the same manufacturing equipment; all that is required is changing the pigment in the plastic. Thus, unlike the prior art, only one set of molding or forming machinery is required.

The filling and joining steps can be conducted in any order after manufacture. For example, the bottles can be individually filled and then later joined by a suitable process to form the container. Alternatively, after manufacture, the individual bottles can be joined to form the container, followed by filling. The filling of individual bottles can then be conducted step-wise, or the bottles can be filled simultaneously.

The embodiments discussed herein are non-limiting examples. While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A package for companion products having a first container and a second container, each container comprising:

a body, the body including a mating formation protruding from the body in a direction toward the other container, the mating formation having a mating surface facing at an angle to the direction of protrusion and engaging the mating surface of the other container, wherein the mating surfaces on the first and second containers are the same as one another;

a first generally flat surface adjacent to a first side of the mating formation, and a second generally flat surface adjacent to the mating formation on a second side of the mating formation, opposite to said first side;

a generally flat bottom;

a center of gravity, the center of gravity being in vertical alignment with the generally flat bottom, whereby each container can stand independently of the other container; and a shape, the shape of the first and second containers being the same as one another, wherein the containers are attached to one another and the bottom of each container lies in a common plane.

2. The package of claim 1, wherein each said container further comprises a front defining:

a recessed grip;

a first shoulder positioned above said recessed grip; and a second shoulder positioned below said recessed grip.

3. The package of claim 2, further comprising a shrink-wrap extending around the containers and attaching the containers to one another, the shrink-wrap contacting the recessed grips and terminating, in a direction transverse to the direction of extending, below said first shoulder and above said second shoulder.

4. The package of claim 2, wherein each container further comprises a back and opposite sides, and the mating formation is positioned on the back, generally midway between the opposite sides.

5. The package of claim 1, wherein each container further comprises a narrow side and a wide side.

6. The package of claim 1, further comprising an adhesive attaching the containers to one another.

7. The package of claim 6, wherein the adhesive is on said mating surfaces.

8. The package of claim 1, further comprising a shrink-wrap extending around the containers and attaching the containers to one another.

9. The package of claim 8, wherein said shrink-wrap comprises a label.

10. The package of claim 1, wherein each container has a front, a back and opposite sides, and the mating formation is positioned on the back, generally midway between the opposite sides.

11. The package of claim 1, wherein each container further comprises a neck offset from the vertical centerline of its container.

12. The package of claim 11, wherein the neck of each container has a structure for retaining a closure.

13. The package of claim 11, wherein the necks are spaced from one another.

14. The package of claim 1, wherein each container has a curved surface opposite to the mating formation, the curved surface being made of a pliable material such that the curved surface is deflectable by squeezing by hand.

15. A package for companion products having a first container and a second container, each container comprising:

a body, the body including a mating formation protruding from the body in a direction toward the other container, the mating formation having a mating surface facing at an angle to the direction of protrusion and engaging the mating surface of the other container;

a first generally flat surface adjacent to a first side of the mating formation, and a second generally flat surface adjacent to the mating formation on a second side of the mating formation, opposite to said first side;

a generally flat bottom; and a shape, the shape of the first and second containers being the same as one another, wherein said shape comprises means for enabling the mating surfaces to be brought into engagement with one another by movement in a plane parallel to the generally flat bottoms of the containers when the generally flat bottoms are in a common plane.

16. The package of claim 15, wherein the first and second generally flat surfaces of the first container are in substantially flush contact with the second and first surfaces, respectively, of the second container.

17. The package of claim 16, wherein said first and second generally flat surfaces lie in planes that are parallel to and spaced from one another.

18. The package of claim 15, wherein each container further comprises a center of gravity, the center of gravity being in vertical alignment with the generally flat bottom, whereby each container can stand independently of the other container.

19. A method of in making a package for companion products, wherein the package has a first container and a second container each having an outer surface and a generally flat bottom, the method comprising:

providing each container with a shape the same as the shape of the other container and with a protrusion extending in a direction outward from the outer surface;

providing each protrusion with a mating surface facing in a direction at an angle to the direction of protrusion extension, wherein the mating surfaces on the first and second containers are the same as one another, and wherein each container has a first generally flat surface adjacent to a first side of the protrusion, and a second generally flat surface adjacent to the protrusion on a second side of the protrusion, opposite to said first side;

orienting at least one of the containers such that the generally flat bottoms lie in the same plane and each protrusion extends generally towards the other container;

moving at least one of the containers toward the other in a plane parallel to the generally flat bottoms such that the mating surfaces come into engagement with one another; and attaching the containers to one another so that the first and second generally flat surfaces of the first container are in substantially flush contact with the second and first surfaces, respectively, of the second container.

20. The method of claim 19, wherein the movement comprises a single straightline movement.

21. The method of claim 19, wherein the step of attaching comprises adhering the containers to one another with an adhesive.

22. The method of claim 21, wherein the mating surfaces are adhered to one another.

23. The method of claim 19, wherein the step of attaching comprises positioning a shrinkwrap around and in contact with the containers.

24. The method of claim 23, further comprising:

providing a recessed grip in each container, wherein the step of attaching comprises positioning the shrink wrap in the recessed grips.

25. The method of claim 19, wherein said moving is in a direction transverse to the direction of protrusion extension.

26. The method of claim 19, wherein the step of orienting comprises sensing the orientation of said first container relative to said second container, and turning said first container to a position in which the mating surface of the first container contacts the mating surface of the second container after the moving step is performed.

27. The method of claim 26, wherein said sensing comprises detecting the position, relative to the direction of motion of said first container, of a neck of the first container that is offset from the vertical centerline of the container.

28. The method of claim 19, wherein the step of attaching comprises gluing the containers to one another.

29. The method of claim 19, wherein the step of attaching comprises positioning a shrink wrap around said package; and affixing a shrink wrap to maintain the positions of the said containers in said package.

30. The method of claim 19, further comprising employing the engagement of the mating surfaces with one another to stop said moving.

* * * * *